United States Patent [19]

Barlow

[11] Patent Number: 4,665,886

[45] Date of Patent: May 19, 1987

[54] BOWSTRING RELEASE MECHANISM

[76] Inventor: William J. Barlow, Rte. 1, Box 504, Norwood, N.Y. 13668

[21] Appl. No.: 497,023

[22] Filed: May 23, 1983

[51] Int. Cl.[4] ..... F41B 5/00

[52] U.S. Cl. ..... 124/35 A

[58] Field of Search ..... 124/35 A, 24 R, 23 R, 124/20 R, 17, 18

[56] References Cited

U.S. PATENT DOCUMENTS

| | | | |
|---|---|---|---|
| 4,004,564 | 1/1977 | Castonguay | 124/35 A |
| 4,083,348 | 4/1978 | Fletcher | 124/35 A |
| 4,173,210 | 11/1979 | Napier | 124/35 A |
| 4,249,507 | 2/1981 | Marra | 124/35 A |
| 4,316,443 | 2/1982 | Giacomo | 124/35 A |
| 4,392,475 | 7/1983 | Fletcher | 124/35 A |

FOREIGN PATENT DOCUMENTS

| | | | |
|---|---|---|---|
| 2053009 | 2/1981 | United Kingdom | 124/35 A |

*Primary Examiner*—Richard J. Apley
*Assistant Examiner*—Robert Bahr
*Attorney, Agent, or Firm*—Bruns and Wall

[57] ABSTRACT

A hand held device for drawing and firing a bow that includes a housing containing a latch for engaging the bowstring and a balanced beam for holding the latch in a locked condition. A trigger mechanism is adapted to unbalance the beam when it is depressed a first distance. A spring loaded arm is adapted to be coupled to the trigger by a sear in a loaded condition so that when the trigger is depressed a distance less than the first distance the arm is uncoupled allowing the arm to strike the beam and thus fire the bow at a reduced trigger pressure.

9 Claims, 5 Drawing Figures

BOWSTRING RELEASE MECHANISM

BACKGROUND OF THE INVENTION

This invention relates generally to an archery device and, in particular to a hand held trigger release mechanism for improving accuracy.

Devices for helping an archer draw and fire a conventional bow have been used for some time. Typically, these devices are hand held units that releasably engage the bowstring so that the archer can draw the bow to a firing position using a hand grip rather than a finger grip. The bowstring is released or fired by operation of a finger actuated trigger.

In U.S. Pat. No. 4,009,703 to Cunningham there is disclosed a hand held unit wherein the bowstring is secured within a circular housing by means of a latched cam. The latching force for holding the cam latched is provided by the bowstring tension which is exerted directly on the cam. Actuating the trigger pulls the latch back against the tension of the bow. As can be seen, the triggering force needed to fire the bow can change drastically each time the bow is fired. Accordingly, the archer is never sure when release will occur and his accuracy is adversely affected.

One other problem that is inherent in many prior art release mechanisms involves the natural reaction of the bowstring to return directly to its normal untensioned position when released. Any spin or lateral displacement imparted to the string at the time of release will produce an unwanted reaction in the string which results in reduced accuracy. The trigger release shown in the above noted Cunningham patent employs a rotatable release cam that physically moves across the bowstring before release causing the string to be released in a twisted condition. Similarly, the Cunningham trigger is arranged to be actuated by the archer depressing his thumb in a direction that is oblique to the intended line of flight of the arrow. Pushing the trigger in this manner against the high holding force exerted by the bowstring invariably causes the hand to move during release disturbing the trajectory of the arrow.

In U.S. Pat. No. 4,083,348 to Fletcher, there is disclosed a bow drawing and release mechanism that overcomes some of the problems found in the prior art. Fletcher utilizes a flexible cord to engage and hold the bowstring during draw. The cord encircles the bowstring and is looped over a rotatable latch that forms part of the triggering mechanism. When the latch is released at firing, the cord, having greater flexibility than the taut bowstring, falls away from the string without imparting a spin thereto. The trigger of the Fletcher device is also arranged to be pulled rearwardly in a direction generally parallel to the intended flight of the arrow. This, in turn, reduces the tendency of the archer to turn his hand at release and results in improved accuracy.

The Fletcher device, like that described by Cunningham, however, employs the bow tension to hold the triggering mechanism in a cocked position. Because the triggering mechanism is directly coupled to the tensioned bow, actuation of the trigger is adversely affected by this unwanted and highly irregular force. The tension of the bow at the moment of firing can change between each draw and the archer is never sure when the trigger will release the bowstring. This uncertainty as to the exact moment of fire adversely affects accuracy. Furthermore, it is not possible to adjust the triggering mechanism with any degree of accuracy to obtain release of the bow repeatedly at a desired trigger pressure. The release pressure of the triggering mechanism must be set while the bow is actually being drawn. This makes adjusting the trigger extremely difficult particularly under field conditions.

The Fletcher trigger mechanism relies upon an over center linkage to withstand the direct bow tension during draw. Any slight misalignment of this linking through mishandling or misadjusting of the device, can produce premature firing of the arrow and thus pose a potential danger to the user or others close by.

SUMMARY OF THE INVENTION

It is therefore an object of this invention to improve the accuracy of a conventional bow.

A further object of the present invention is to improve trigger release mechanism that is used in conjunction with a conventional bow.

A still further object of the present invention is to provide a trigger release mechanism for a conventional bow which can be independently set to release repeatedly at a given trigger pressure regardless of the bowstring tension.

Another object of the present invention is to prevent the premature firing of a bow during the drawing and release of an arrow.

Yet another object of the present invention is to provide a bow drawing and triggering mechanism that has two separate trigger release pressures which can be independently selected by the archer.

A still further object of the present invention is to provide a bow drawing and release mechanism that has a generally symmetrical construction so that it can be operated by either hand without adjustment.

Yet another object of the present invention is to provide a trigger release mechanism for a bow which can be quickly and accurately adjusted in the field without having to operatively connect the mechanism to the bow.

These and other objects of the present invention are attained by means of a hand held device for drawing and firing a conventional bow that includes a retaining mechanism for operatively engaging the bowstring during the draw and an independent triggering mechanism for releasing the bowstring at the time of firing. The retaining mechanism contains a spring balanced beam that acts in conjunction with a latch to independently withstand the tension exerted by the bowstring against the latch as the bowstring is pulled into a firing position. The triggering mechanism is isolated from the restraining mechanism and includes a pair of trigger assemblies that are interconnected by a sear. A firing trigger is arranged to displace the balanced beam when pulled at a first normal pressure. The second cocking trigger, when pulled, closes the sear. This, in turn, spring loads an actuating arm in a condition such that the arm is driven in contact with the beam when the sear is opened. Opening the sear is accomplished by pulling the firing trigger with a lighter than normal pressure.

BRIEF DESCRIPTION OF THE DRAWINGS

For a better understanding of these and other objects of the present invention, reference is had to the detailed description of the invention which is to be read in conjunction with the following drawings, wherein.

DESCRIPTION OF THE INVENTION

Figure 1:
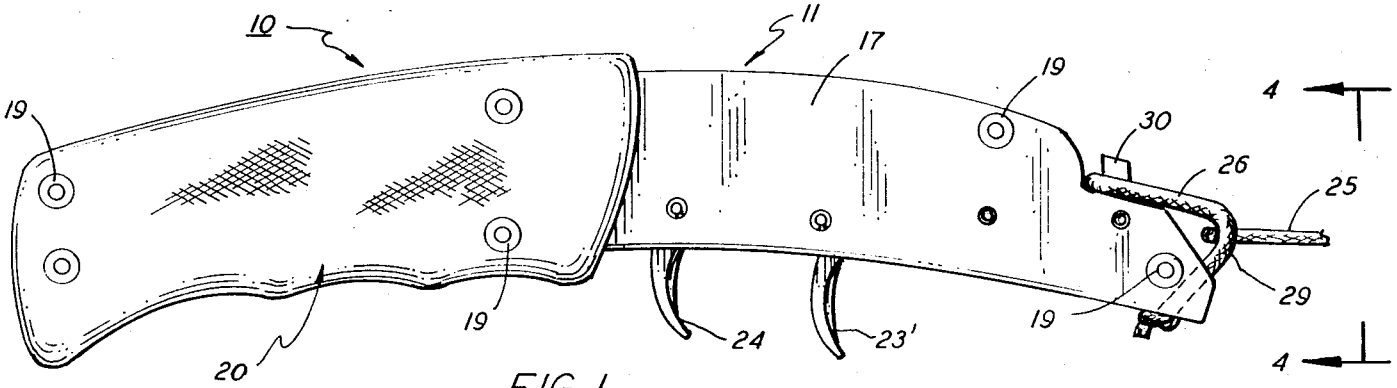
FIG. 1 is a side elevation of a bow drawing and trigger release mechanism embodying the teachings of the present invention.

Referring now to the drawings and, in particular, to FIGS. 1–4, there is illustrated a hand held device, generally referenced 10, used by an archer in drawing and firing a conventional bow. The term "conventional bow" as herein used refers to a bow of the type wherein the archer holds the body of the instrument in one hand and draws the bowstring against the flex of the bow limbs using the other hand. It is immaterial for the purposes of this invention whether the bow is of simple or compound construction. The instant device includes an elongated housing 11 that has a top wall 12 and a bottom wall 13 which coacts to form an enclosure 14. An opening 15 is contained in the front end wall 16 of the housing that passes into the enclosure. A pair of side coverplates 17 and 18 serve to close the housing and are secured to the top and bottom walls by rivets 19—19. A hand grip, generally referenced 20, is similarly riveted to the back section of the housing. The grip contains a contoured surface that compliments the hand to permit the device to be securely gripped. When normally held, the index finger of the gripping hand is naturally positioned adjacent to a pair of triggers 23 and 24, the purpose of which will be explained in greater detail below.

The bowstring 25 of the weapon (not shown) is engaged by a flexible lanyard 26 that is secured to the front end of the housing. The lanyard is preferably made of high strength nylon cord or the like. Both ends of the cord are passed through a hole 27 formed in the front of the bottom wall and the ends of the lanyard tied off or thermally bonded into a mushroom 28 to form a loop at the enclosure opening. In practice, the loop is brought around the bowstring as shown to form a bight 29 and the loop is then passed over a latch post 30 to secure the bowstring to the housing.

The latch post 30 is part of the bowstring retaining mechanism generally referenced 31 that is capable of independently resisting the tension exerted by the bowstring against the post as the bowstring is drawn to a firing position. The post is rotatably mounted in the front opening of the housing by a pivot pin 32 that is supported between the two side plates. The front surface 33 of the latch post is arranged to swing downwardly against a stop face 34 formed along the top surface of the bottom wall. The stop surface limits the pivotable movement of the latch post in a forward direction.

Figure 2:
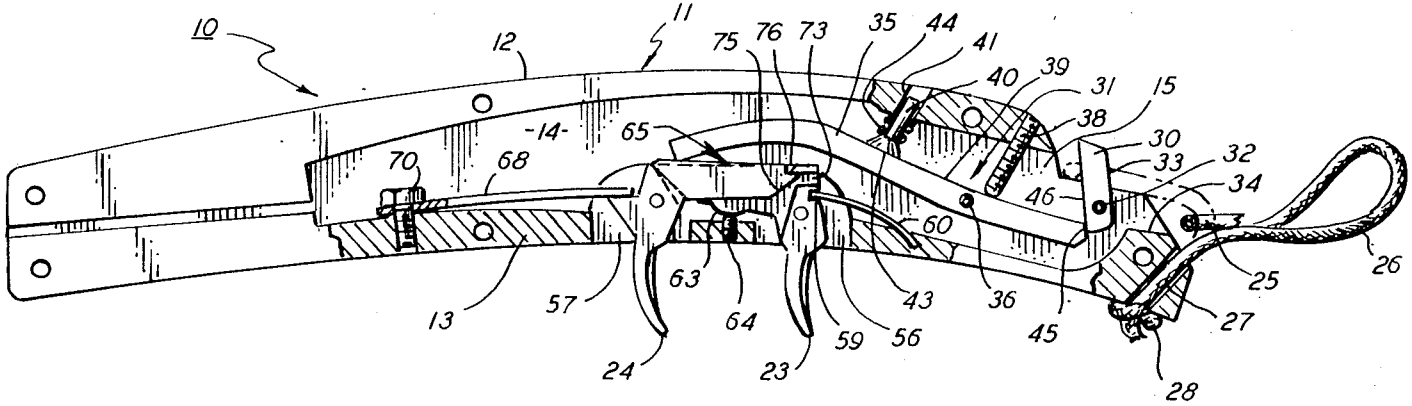
FIG. 2 is a side view of the device shown in FIG. 1 with a side cover removed to reveal the firing mechanism in a fully cocked position ready for firing.
Figure 3:
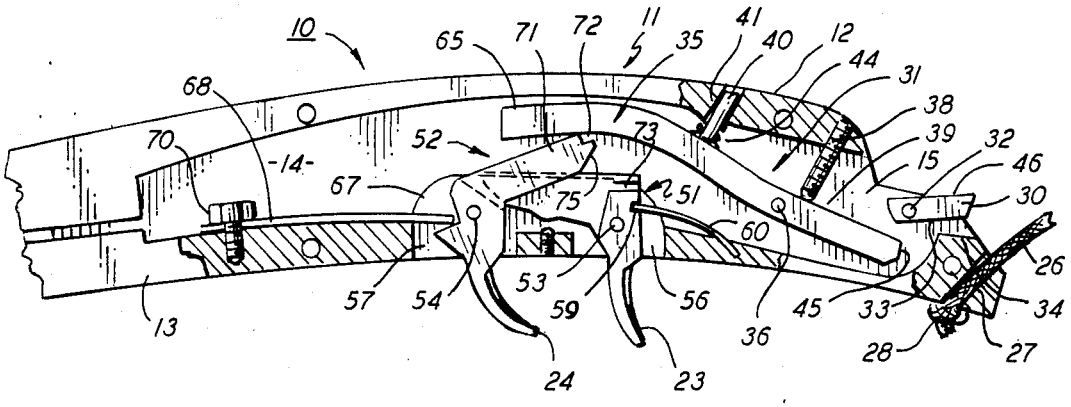
FIG. 3 is a side view similar to that shown in FIG. 2 illustrating the housed firing mechanism.
Figure 4:
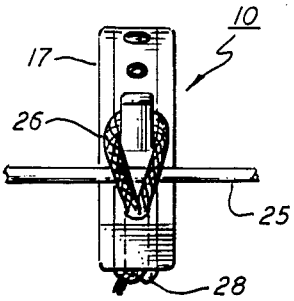
FIG. 4 is a front end view of the device shown in FIG. 1.

When brought to a latched or bowstring securing position as shown in FIG. 2, the post is generally maintained in an upright posture normal to the bottom and top walls through the instrumentality of a spring balanced beam 35. The beam is pivotably supported between the side walls of the housing by means of a pivot pin 36. An adjustable stop 38 is threaded into the top wall of the housing and normally contacts the top surface 39 of the beam forward of the pivot pin 36. A spring loaded member 40 is slidably received within a guideway 41 formed in the top wall of the housing. A compression spring 44 is wound about the body of the member and urges the enlarged head 43 of the member into light biasing contact against the top of the beam. Under the biasing action of the spring 44, the beam is held against the adjustable stop 38 thus positioning the beam generally along the longitudinal axis of the housing.

When seated against the stop 38, the front face 45 of the beam is capable of being seated in abutting contact against the back face 46 of the latch post thereby preventing the post from rotating forward against stop face 34. Accordingly, the post, when latched, is maintained in an upright position by the balanced bar. As shown in FIG. 2, the lanyard is able to be brought about the bowstring and looped over the latched post to operatively attach the housing to the bow. As the bowstring is drawn, the string tension is translated through the latch post to the balanced beam. When balanced, the force exerted by the latched post against the beam acts axially along the beam and is resisted by the pivot pin. Accordingly, the beam will hold the post in a latched position without regard to the bow tension and without the danger of the bow being prematurely fired.

Figure 5:
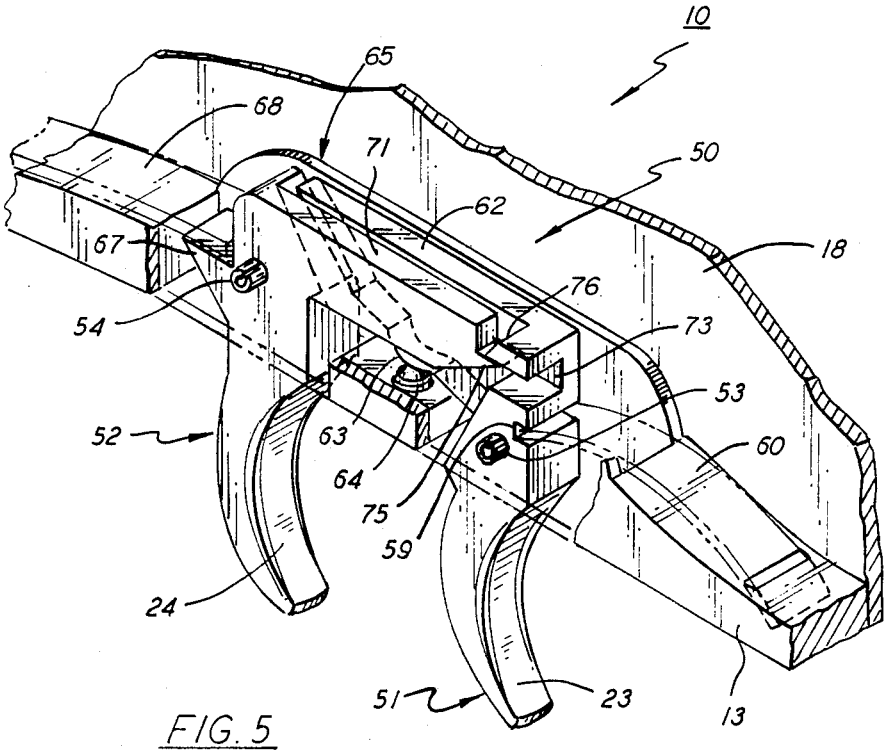
FIG. 5 is a partial perspective view in section showing the trigger mechanism of the present invention and the sear which operatively connects the two embodied trigger units placed in a cocked position.

As best illustrated in FIG. 5, the apparatus of the present invention further includes an independent triggering mechanism generally referenced 50. The triggering mechanism contains a pair of trigger units that includes a front assembly 51 containing the previously noted firing trigger 23 and a rear assembly 52 that contains the cocking trigger 24. It should be noted that the triggering mechanism is not physically connected to the bowstring retaining mechanism and thus is not affected by the bow tension. Each trigger is rotatably mounted in the bottom wall of the housing by pins 53 and 54 so that the triggers depend downwardly from the wall through openings 56 and 57.

The front or firing trigger 23 has a notch 59 cut in its front face. One end of a leaf spring 60 is seated in the notch and the other end of the spring is anchored in the bottom wall of the housing. The front trigger assembly further includes a rearwardly disposed arm 62 that has a flange 63 on the bottom surface thereof that seats upon an adjusting screw 64 threaded in the bottom wall of the housing. The arm 62 is of sufficient length so that it can be raised into contact with the arcuate rear section 65 of the beam as the trigger 23 is pulled rearwardly against spring 60. The extended arm of the firing trigger, during firing, raises the beam a short distance to free the latch post and thus releases the retaining lanyard allowing the bow to fire.

The rear or cocking trigger 24 is positioned slightly behind the firing trigger so that the index finger on the firing hand can gain ready access thereto. The cocking trigger has a shoulder 67 formed in the back wall thereof in which is seated the free end of a flat firing spring 68. The back of the spring is secured to the bottom wall of the housing by a capscrew 70. The flat spring exerts a rotational force on the cocking trigger which urges the trigger in a counterclockwise direction as viewed in FIGS. 2 and 3. The cocking trigger has a forwardly disposed arm 71 that is positioned adjacent to the rearwardly disposed arm 62 of the firing trigger. The two arms coact to form a sear. The front face of forwardly disposed arm 71 has a recessed shoulder 72 cut in the top surface thereof that is capable of being received in a notch 73 formed in the side wall of the firing trigger thus operatively connecting the two trigger assemblies. An inclined surface 75 is also formed on the front face of arm 71 that is adapted to ride in sliding contact against a coacting surface 76 on the firing trigger when the cocking trigger is pulled.

Pulling the cocking trigger forces the inclined surface 75 to ride down the contacting surface 76 upon the firing trigger assembly whereby the firing trigger is rotated slightly against the biasing pressure of the leaf spring 60. When the recessed shoulder 72 enters the notch 73, the front trigger unit snaps back thus locking the sear. At this time, the firing spring is held in a loaded condition against the cocking trigger; however, it cannot be unloaded until the sear is unlocked. The sear is unlocked by depressing the firing trigger. A very light pull on the firing trigger, which depresses the trigger a shorter distance than normally required to fire the bow is all that is required to permit the firing spring to unload. When this occurs, the arm 71 of the cocking trigger is driven forcefully against the back of the balanced beam displacing the beam and thus allowing the bow to fire. The locking force on the sear can be independently adjusted using the previously noted adjusting screw 64 so that the firing pull can be finely set by the archer at a desired level. When, the sear is opened, the arm 71 is positioned by the firing spring just below the beam. At this time the spring is in full contact against the lower wall of the housing and is unable to load the cocking trigger until such time as the trigger is pulled.

In view of the foregoing, it should be apparent that the present invention provides an improved bowstring draw and release mechanism that is relatively simple in construction and which functions to deliver improved accuracy and safety while providing the archer with a first normal trigger release setting and a second finer trigger release setting.

While this invention has been described with reference to the details as set forth above, it is not limited to the specific structure as disclosed and the invention is intended to cover any modifications or changes as may come within the scope of the following claims.

I claim:

1. Apparatus for drawing and releasing a bowstring that includes an elongated housing having a hand grip affixed at the back end thereof and an opening formed in a front wall of the housing, a latch post pivotably mounted in the opening so that the top portion thereof extends beyond the opening, said post being pivotable between a first latched position wherein the post is generally aligned perpendicular to the longitudinal axis of the housing and an unlatched position wherein the post is seated against a stop surface formed in the front wall of the housing generally aligned parallel with said longitudinal axis, a balanced beam mounted on a pivot pin within the housing and further having a front face that abuts the lower portion of the post when the post is in a latched position, a spring balance acting upon the beam to normally support the beam in alignment with the longitudinal axis of the housing, a flexible loop secured in the front wall of the housing for encircling a bowstring and passing over the post when the post is in a latched position whereby the bowstring tension is resisted by the beam, a finger actuated trigger means independently mounted in the housing in non-contiguous relation with the beam having a member movably connected thereto that moves into contact with the beam to displace said beam when the trigger means is actuated at a normal release pressure thereby releasing the bowstring, a spring driven arm for moving into displacing contact against the beam that is coupled to the trigger means by a sear so that when the sear is closed the arm is loaded against the spring and actuating the trigger opens the sear causing the bowstring to be released, and adjusting means operatively associated with the sear for setting the sear opening trigger pressure below the normal trigger release pressure.

2. The apparatus of claim 1 that further includes a second finger actuated trigger means connected to the arm which when actuated closes the sear.

3. Apparatus for drawing and releasing a bow that includes a hand-held housing having a post pivotally supported therein so that the post moves between a locked and an unlocked position, a flexible lanyard for encircling a bowstring and engaging the post to secure the bowstring to the housing when the post is in a locked position and for releasing the bowstring when the post is moved to an unlocked position, a beam being mounted in a pivot behind the post and having balancing means associated therewith for holding the beam against the post to support the post in a locked position, a finger actuated firing trigger mounted in the housing in non-contiguous relation with the beam, said firing trigger having a first arm that is pivotally mounted in the housing for moving into contact with the beam when the firing trigger is pulled at a first pressure to a normal firing position to displace the beam sufficiently to unlock the post and thus release the bowstring, a second arm also pivotally mounted in the housing for contacting said beam, a spring capable of being loaded against the second arm to drive said second arm into striking contact against the beam to displace the beam sufficiently to unlock said post, a sear having a notch means for coupling the second arm to the firing trigger with the spring loaded against said second arm, means for uncoupling the sear when the firing trigger is pulled at a second pressure that is less than the first pressures whereupon the bowstring is released.

4. The apparatus of claim 3 that further includes means for adjusting the trigger pressure required to uncouple the sear.

5. The apparatus of claim 3 that further includes a contoured hand grip affixed to the outside of the housing to provide a secure surface for grasping the housing.

6. The apparatus of claim 3 wherein said second arm is connected to a cocking trigger mounted in the housing behind the firing trigger which couples the sear to the firing trigger when the cocking trigger is pulled.

7. Bow drawing apparatus for selectively releasing the bowstring at two differing pull pressures that includes a hand-held housing for engaging a bowstring to permit the bow to be drawn, a latch mechanism mounted in the front of the housing that is movable between a locked position wherein the bowstring is releasably secured to said housing and a release position wherein the secured bowstring is freed from the housing, a beam pivotally mounted in the housing for normally holding the latch mechanism in a locked position and which can be displaced about the pivot to allow the latch mechanism to move to a release position, a first firing trigger having an arm which displaces the beam when a first pull pressure is applied to the firing trigger, a second cocking trigger having a spring biased arm that is moved to a spring loaded position when the cocking trigger is pulled wherein the biased arm is capable of being driven by the spring into displacing contact against said beam, a sear means for coupling the spring biased arm of the cocking trigger to the firing trigger when said cocking trigger is pulled and for uncoupling the spring biased arm when the firing trigger is pulled at a second pressure that is less than said first pressure.

8. The apparatus of claim 7 wherein the housing is an elongated member and the firing trigger is located in front of the cocking trigger.

9. The apparatus of claim 7 that further includes adjusting means for selectively setting said second pull pressure.

* * * * *